United States Patent [19]

Li

[11] Patent Number: 4,503,691

[45] Date of Patent: Mar. 12, 1985

[54] COMBINATION LOCK

[76] Inventor: Hung-Wen Li, 13 Tingchu Li, Lukang Chen, Changhua Hsien, Taiwan

[21] Appl. No.: 217,148

[22] Filed: Dec. 16, 1980

[51] Int. Cl.[3] ..... E05B 37/02; E05B 65/52

[52] U.S. Cl. ..... 70/312; 70/316

[58] Field of Search ..... 70/3, 4, 5, 67, 68, 70/69, 70, 71, 72, 73, 74, 75, 76, 312, 315, 316, 317, 318

[56] References Cited

U.S. PATENT DOCUMENTS

| | | | |
|---|---|---|---|
| 1,410,033 | 3/1922 | Paes | 70/317 |
| 1,606,279 | 11/1926 | Wildrick | 70/318 |
| 2,267,374 | 12/1941 | Eber | 70/312 |
| 4,267,716 | 5/1981 | Milles | 70/312 |

*Primary Examiner*—Robert L. Wolfe

[57] ABSTRACT

A combination lock of the type which may be used with attache cases and the like. The combination is changeable by actuating the same element which unlatches the lock. A latch element is provided which is movable between latched and unlatched positions. A shaft is coupled to the latch element and a plurality of sleeves are rotatably mounted on the shaft. A plurality of dials are, in turn, rotatably mounted on the sleeves and means are provided for selectively engaging the dials with their associated sleeves. A manual actuator is provided for manually moving the shaft and latch element to the unlatched position and for concurrently disengaging the engaging means when the dials are set on combination. When the dials are off combination, the manually actuating means is inhibited from such movement.

5 Claims, 7 Drawing Figures

COMBINATION LOCK

BACKGROUND OF THE INVENTION

The present invention relates to a novel combination lock, and particularly to a combination lock adapted for use on attache cases and the like wherein the combination of the combination lock may be changed by actuating the same number which is used to open the lock.

The prior art combination locks make use of a separate manual changing lever to enable the combination to be changed. One such prior art lock is shown in FIG. 1 of the drawings. Another example of such a combination lock is described in U.S. Pat. No. 4,318,287.

As can be seen from FIG. 1 of the drawings, the prior art combination lock includes a lever which protrudes from the rear of the housing for the lock. In use, this lever requires that an opening be provided in the item utilizing the lock to provide access to the lever. For example, if this lock is used with an attache case, an opening must be provided inside the attache case for access to the aforementioned lever. The disadvantage of the prior art lever is that it is rather unsightly, especially if the attache case is of high quality, perhaps made of leather. It is believed that not only does the present combination lock not improve the inner beauty of a leather attache case but also it makes the changing of the combination an easier task. Also, the combination lock disclosed herein is of simple design and has relatively few piece parts thereby making it less costly to produce.

SUMMARY OF THE INVENTION

The foregoing objects are achieved as is now described. The combination lock includes a latching element which is movable between latched and unlatched positions. A shaft is provided which is coupled to said latch element means. A plurality of sleeves are provided which are rotatably mounted on the shaft and a pluralily of dials are provided which are rotatably mounted on the sleeves. Means are provided for selectively engaging the sleeves with the associated dials. A manually actuated mechanism is provided for moving the shaft and latch element to the unlatched position and for concurrently disengaging the engaging means when the dials are set on combination. When the dials are set off combination, the manually actuated mechanism is inhibited from such movement. When the engaging means is disengaged, the dials are free to rotate with respect to their associated sleeves, thereby permitting the combination to be changed as desired.

BRIEF DESCRIPTION OF THE DRAWINGS

The novel features believed characteristic of the invention are set forth in the appended claims. The invention itself, however, as well as the preferred mode of use, and other objects and advantages thereof, will best be understood by reference to the following detailed description of an illustrative embodiment when read in connection with the accompanying drawings wherein:

DETAILED DESCRIPTION OF THE INVENTION

Figure 1:
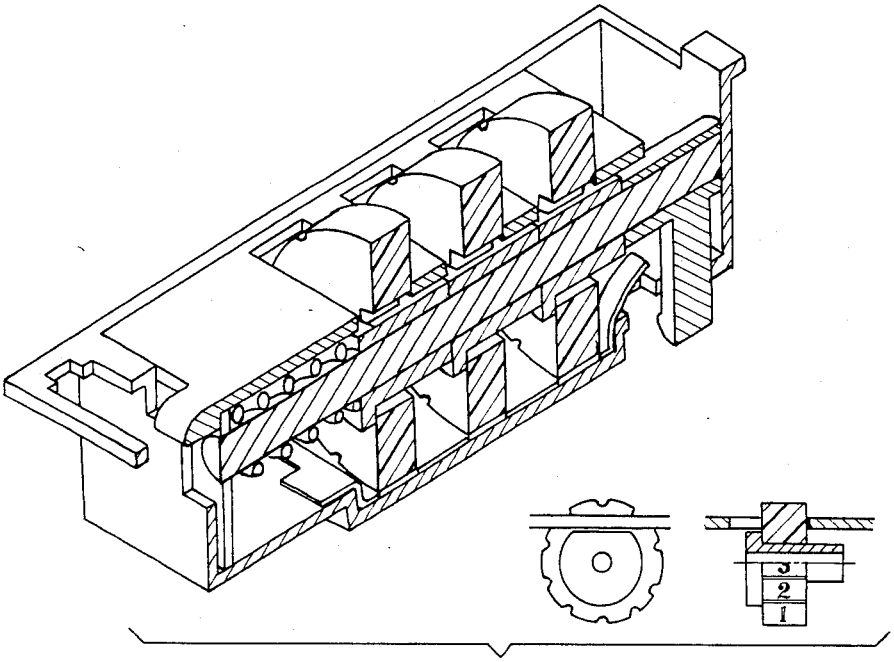
Fig 1 PRIOR ART
FIG. 1 is a partially cut-away view in perspective of a prior art lock.

A conventional combination lock is shown in FIG. 1 wherein several sleeves and their associated dials are rotatably mounted on a shaft. A combination changing lever is disposed at one end of the shaft and in front of a spring baffle. A combination changing lever protrudes through the rear of the housing containing the combination lock.

Each sleeve has a flat surface associated therewith and when the dials are rotated so as to display the correct combination, the flat surfaces of each of the sleeves are disposed upwards permitting relative movement of the leaf and hasping element.

The structure of this prior art device is rather complex and can be easily damaged. If it is desired to change the combination, it is necessary to actuate the combination changing lever in order to permit the dials to be rotated with respect to their associated sleeves.

Figure 2:
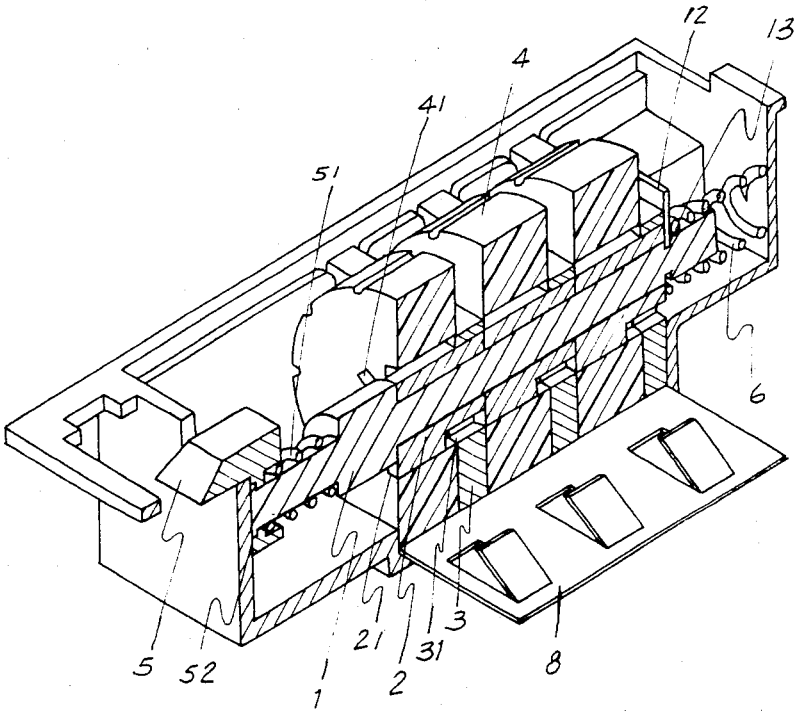
FIG. 2 is a partially cut-away view in perspective of a lock employing the present invention.
Figure 7:
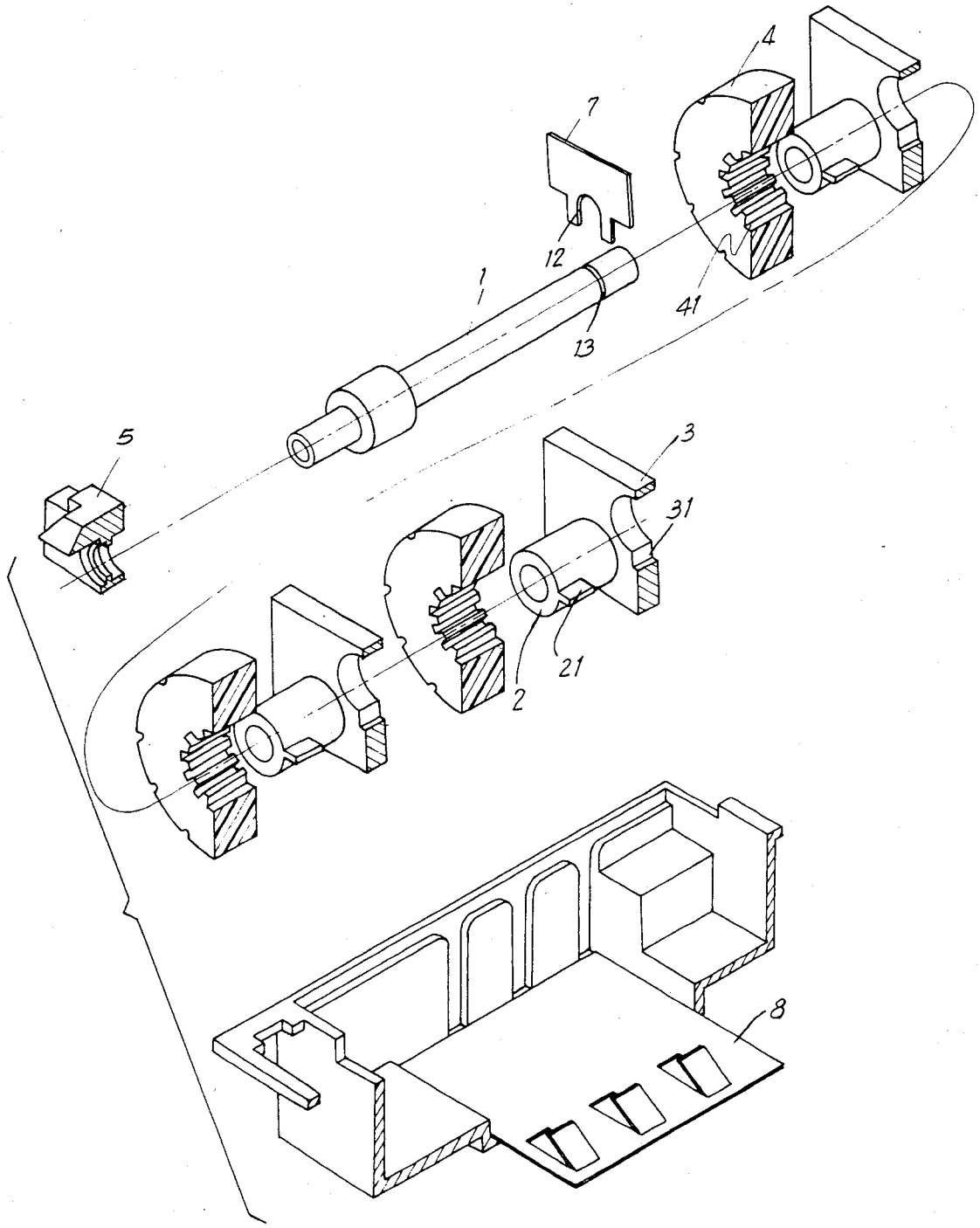
FIG. 7 is an exploded partial section view in perspective of the lock of FIG. 2.

Turning to FIG. 2, it is there shown a partially cutaway perspective view of the lock of the present invention. In FIG. 7, there is shown an exploded perspective view thereof. A shaft 1 is provided on which several sleeves 2 are rotatably mounted. Each sleeve 2 is equipped with a tooth 21. On each sleeve 2 is mounted a rotary dial 4. Each dial 4 is equipped with a plurality of tooth receiving notches 41. When the tooth 21 of sleeve 2 is received in notch 41 of its associated dial 4, then the rotation of dial 4 causes sleeve 2 to rotate therewith. Between the dials 4 are disposed blocks 3 which are fixed in the combination lock's housing. Each block 3 has an opening therein for receiving a portion of sleeve 2 as well as a single tooth receiving notch 31 for receiving tooth 21 of the adjacent sleeve 2 when the associated dial 4 is on its proper combination.

Figure 6:
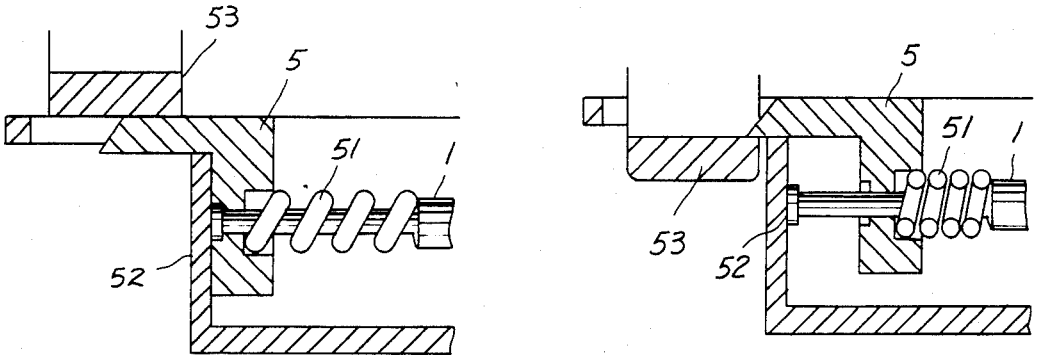
FIG. 6 shows the latch element engaging a hasp.

A hasping block 5 is disposed at one end of shaft 1, and is urged outwardly (to the left in the Figures) by spring 51 so as to engage a hasp 53 (See FIG. 6) when locked. Spring 51 also permits hasping block 5 to move axially along the shaft away from hasp 53 (to the right in the Figures) when the lock is desired to be closed irrespective of whether or not the dials 4 are on their correct combination. A flange 52 is formed on the end of shaft 1 after hasping block 5 is received thereon to thereby couple hasping block 5 to shaft 1 and cause hasping block 5 to be moved away from hasp 53 when shaft 1 is pulled in that direction when the lock is opened.

The other end of shaft 1 is provided with a groove 13 for receiving tines 12 of leaf 7 which is actuated when it is desired to open the lock. A spring 6 is provided which bears on leaf 7 so as to urge shaft 1 towards hasp 53 and the front of the lock housing.

Figure 3:
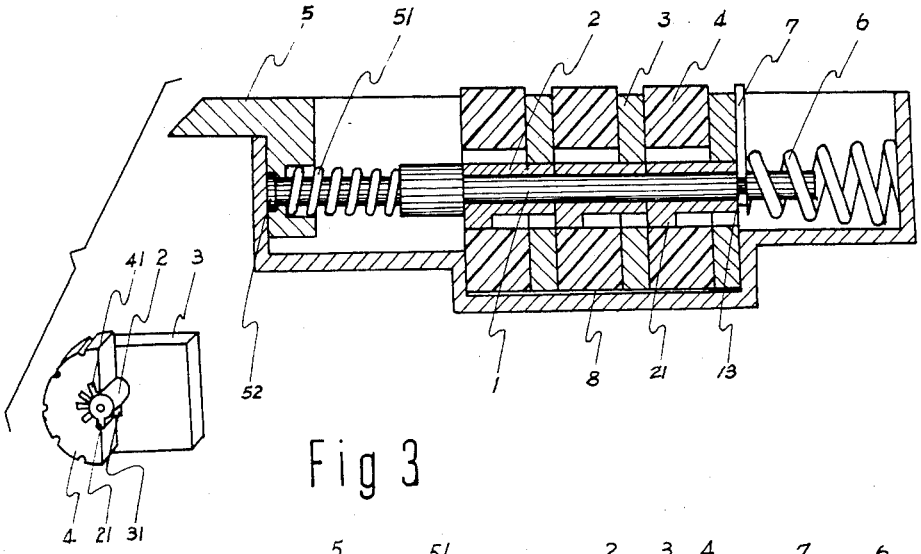
FIG. 3 is a side elevational view in section of the lock depicted in FIG. 2, with the lock shown in its latched position and the combination dials shown on combination.
Figure 4:
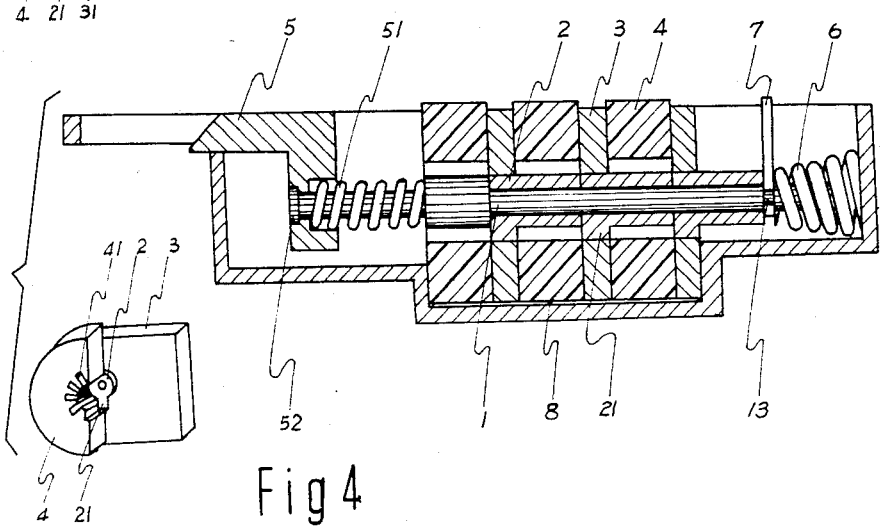
FIG. 4 is a view as in FIG. 3, but with the lock shown in its unlatched position.
Figure 5:
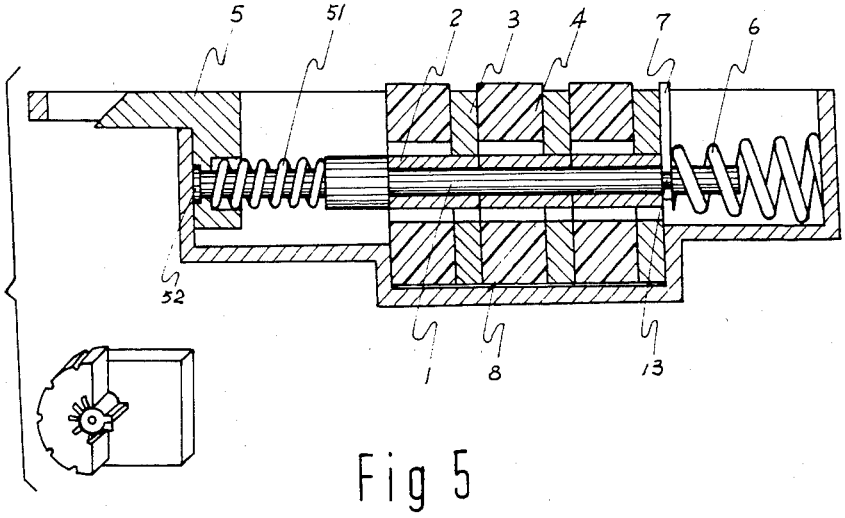
FIG. 5 is a view as in FIG. 3, but with the combination dials shown off combination.

Turning now to FIGS. 3–5, the operation of the lock and its combination changing abilities will be more fully appreciated. In FIG. 3, the lock is shown in a locked position, however, the teeth 21 on sleeves 12 are shown aligned with notches 31 of blocks 3 and thus the dials 4 have been rotated to the correct combination for opening the lock. Thereafter, as leaf 7 is mechanically moved rearwardly (to the right in the Figures) by the person utilizing the lock, teeth 21 of sleeves 2 enter notches 31 thereby permitting shaft 1 to fully retract hasping block 5 from hasp 53 (FIG. 6) and permitting the hasp 53 to disengage and the lock to open. At this point it should be noted that teeth 21 no longer engage any of the notches 41 in dials 4 and thus dials 4 may be rotated with respect to their associated sleeves 2 when leaf 7 has been mechanically actuated as shown in FIG. 4.

Thus, when leaf 7 is being actuated to open the lock, it is also possible to change the combination of the lock by merely rotating dials 4 to the newly desired combination. When leaf 7 is subsequently released, teeth 21 of the sleeves 2 will engage different notches 41 in their associated dials 4 for each dial 4 which was rotated to a new combination position.

FIG. 5 shows the combination lock after leaf 7 has been released and dials 4 thereafter rotated off combination. As can be seen, teeth 21 no longer align with notches 31 and therefore should one now attempt to open the lock by pulling back on leaf 7, the teeth 21 will engage the surface areas of blocks 3 around the opening therein, inhibiting the full movement of shaft 1 to the right as seen in the figures. Thus, hasping block 5 will continue to engage hasp 53 and the lock remains locked.

As can be seen, the same mechanism which is used to operate and open the lock is also used to enable the changing of the combination of the lock. While my invention has been described with respect to a single embodiment thereof, modification will now suggest itself to those skilled in this art. The invention itself is not limited to the embodiment disclosed, except as required in the appended claims.

I claim:

1. A resettable combination lock comprising:

latch element means movable between latched and unlatched positions;

a shaft coupled to said latch element means;

a plurality of sleeves rotatably mounted on said shaft;

a plurality of dials rotatably mounted on said sleeves;

means for selectively engaging ones of said sleeves with ones of said dials; and manually actuated means for moving said shaft and said latch element means to said unlatched position and concurrently disengaging said engaging means when the dials are set on combination and for inhibiting such movement when the dials are off combination.

2. The combination lock of claim 1, wherein said shaft is urged to said latched position by a first spring and said latch element means is urged to an end of said shaft remote from said first spring by means of a second spring.

3. The combination lock of claim 1, further including a housing and a plurality of block elements having openings therein for receiving said sleeves, said lock elements being secured in said housing and disposed between adjacent ones of said dials.

4. The combination lock according to claim 3, wherein each of said dials has a plurality of notches and said block has a single notch, and said sleeves have a single tooth sized to be received by said notches.

5. The combination lock according to claim 4, wherein said sleeves have a pedetermined outside nominal diameter and wherein shaft has an enlarged portion having essentially the same outside diameter as the nominal outside diameter of said sleeves, said built-up portion engaging the side of a first one of said sleeves, the other side of first one of said sleeves engaging the side of a second one of said sleeves and so forth for the remainder of said plurality of said sleeves, said sleeves moving actually with respect to their associated dials when said shaft is actually moved in order to open the lock.

* * * * *